US011812862B2

(12) United States Patent
Sun

(10) Patent No.: US 11,812,862 B2
(45) Date of Patent: Nov. 14, 2023

(54) FOLDABLE ROCKING CHAIR

(71) Applicant: Zhejiang Pride Leisure Products Co,. Ltd., Jinhua (CN)

(72) Inventor: Benlong Sun, Jinhua (CN)

(73) Assignee: ZHEJIANG PRIDE LEISURE PRODUCTS CO., LTD., Zhejiang Province (CN)

( * ) Notice: Subject to any disclaimer, the term of this patent is extended or adjusted under 35 U.S.C. 154(b) by 3 days.

(21) Appl. No.: 17/579,625

(22) Filed: Jan. 20, 2022

(65) Prior Publication Data

US 2023/0200535 A1 Jun. 29, 2023

(30) Foreign Application Priority Data

Dec. 27, 2021 (CN) ..... 202111612131.1

(51) Int. Cl.

| | |
|---|---|
| ***A47C 3/02*** | (2006.01) |
| ***A47C 3/025*** | (2006.01) |
| ***A47C 4/28*** | (2006.01) |
| ***A47C 4/42*** | (2006.01) |

(52) U.S. Cl.

CPC ..... *A47C 3/02* (2013.01); *A47C 3/025* (2013.01); *A47C 3/0255* (2013.01); *A47C 4/283* (2013.01); *A47C 4/42* (2013.01)

(58) Field of Classification Search

CPC ..... A47C 3/02; A47C 3/025; A47C 3/0255; A47C 4/283; A47C 4/42

USPC ..... 297/259.2, 259.4

See application file for complete search history.

(56) References Cited

U.S. PATENT DOCUMENTS

| | | | | |
|---|---|---|---|---|
| 10,568,430 | B1 * | 2/2020 | Sun | A47C 3/02 |
| 11,172,762 | B2 * | 11/2021 | Zhu | A47C 4/283 |
| 11,389,000 | B2 * | 7/2022 | Sun | A47C 3/0252 |
| 11,540,634 | B2 * | 1/2023 | Sun | A47C 4/283 |
| 2014/0097647 | A1 * | 4/2014 | Grace | A47C 3/025 297/42 |
| 2021/0127836 | A1 * | 5/2021 | Sun | A47C 3/0255 |
| 2022/0218109 | A1 * | 7/2022 | Sun | A47C 4/283 |

FOREIGN PATENT DOCUMENTS

| | | | | |
|---|---|---|---|---|
| CN | 213720928 U | * | 7/2021 | A47C 3/025 |

* cited by examiner

*Primary Examiner* — Robert Canfield

(74) *Attorney, Agent, or Firm* — WPAT LAW, P.C.; Anthony King

(57) ABSTRACT

A foldable rocking chair, including a foldable chair frame, a seat cushion cloth and two rocking bars, wherein the seat cushion cloth is detachably installed on the chair frame, and the two rocking bars are installed on left and right sides of the chair frame, respectively; each of the rocking bars includes an upper rocking bar, a torsional spring base, a lower rocking bar and a bottom tube, the upper rocking bar and the lower rocking bar are rotatably connected to both ends of the torsional spring base, and an upper end of the upper rocking bar is rotatably connected to a rear end on the left or right side of the chair frame; and each of the bottom tubes is placed on the ground and includes a front bottom tube and a rear bottom tube.

9 Claims, 4 Drawing Sheets

FOLDABLE ROCKING CHAIR

BACKGROUND OF THE INVENTION

1. Technical Field

The present invention belongs to the technical field of chairs, and in particular, relates to a foldable rocking chair.

2. Description of Related Art

A rocking chair has both a seat function and an added recreational function, which greatly increases the recreation in work and life. When using the rocking chair, people feel relaxed to achieve the purpose of physical and mental pleasure. However, the traditional rocking chair is bulky and inconvenient to move, with a non-foldable complex structure that is poor in stability, and it is inconvenient to move and store before and after use.

BRIEF SUMMARY OF THE INVENTION

In view of the defects above, an objective of the present invention is to provide a foldable rocking chair, which has a light, stable and firm overall structure and is capable of rocking front and back and being folded for storage, thereby reducing the footprint when not in use and facilitating the carrying during transportation.

To achieve the above objective, the present invention employs the following technical solution: a foldable rocking chair includes a foldable chair frame, a seat cushion cloth and two rocking bars, wherein the seat cushion cloth is detachably installed on the chair frame, and the two rocking bars are installed on left and right sides of the chair frame, respectively; each of the rocking bars includes an upper rocking bar, a torsional spring base, a lower rocking bar and a bottom tube, the upper rocking bar and the lower rocking bar are rotatably connected to both ends of the torsional spring base, and an upper end of the upper rocking bar is rotatably connected to a rear end on the left or right side of the chair frame; and the bottom tube is placed on the ground and includes a front bottom tube and a rear bottom tube, a rear end of the front bottom tube is rotatably connected to a front end of the rear bottom tube, a lower end of the lower rocking bar is rotatably connected to a rear end of the rear bottom tube, and the front bottom tube is fixed to a bottom surface on the left or right side of the chair frame.

Further, the rocking bars further include protective sleeves, which are sleeved on bottom surfaces of the front and rear bottom tubes.

Furthermore, the protective sleeves include front protective sleeves and rear protective sleeves, which are sleeved on the bottom surfaces of the front and rear bottom tubes, respectively. When the chair frame rocks to a rear end, the front protective sleeves reverse backwards along with the rotation of the front bottom tube relative to the rear bottom tube, until the bottom of the rear end of the chair frame comes into contact with the rear bottom tube.

Furthermore, skidproof stripes are disposed on the bottom surfaces of the protective sleeves to increase frictions and prevent sliding.

Further, the bottom tubes further include bottom-tube connecting members and rear connecting bases; the front bottom tubes are rotatably connected to the rear bottom tubes via the bottom-tube connecting members; and the rear connecting bases are fixedly connected to the backs of the rear bottom tubes and are simultaneously rotatably connected to the lower ends of the lower rocking bars.

Furthermore, each of the bottom-tube connecting members includes a left connecting section, a right connecting section and two bearings; one end of the left connecting section and one end of the right connecting section are each provided with one of the bearings and are rotatably connected through a pin shaft; and the other end of the left connecting section and the other end of the right connecting section are fixed to the respective front bottom tube and the respective rear bottom tube, respectively.

Further, each of the torsional spring bases includes a torsional spring, as well as an upper torsional-spring protective cover and a lower torsional-spring protection cover which are installed on upper and lower ends of the torsional spring respectively; the upper torsional-spring protective cover and the lower torsional-spring protective cover are rotatably connected by taking the torsional spring as a center; and the upper torsional-spring protective cover and the lower torsional-spring protective cover are connected to the upper end of the respective upper rocking rods and the lower end of the respective lower rocking bar, respectively.

Further, the chair frame includes two side frame tubes, two back tubes, and two U-shaped tubes that are crossed and riveted; the side frame tubes are closed rings formed from bent tubes, and the back tubes are pluggably installed on openings on upper backs of the side frame tubes; the upper front and the upper back of each of the side frame tubes are provided with a connecting piece, respectively, two bent ends of each of the U-shaped tubes are riveted with one of the connecting pieces, and two bottoms of each of the U-shaped tubes are rotatably connected to a lower front and a lower back of the opposing side frame tube; and two sides of an upper section of the seat cushion cloth are fixed to the back tubes, and two sides of a lower section of the seat cushion cloth are fixed on cross tubes of the U-shaped tubes, respectively.

Furthermore, each of the connecting pieces includes a left connecting piece and a right connecting piece, the left connecting piece is a Z-shaped connecting piece, which has a fixation effect without blocking the respective left U-shaped tube during rocking, and the right connecting piece is a straight connecting piece;

or, a support pad is disposed on a lower section, which is in contact with the respective bottom tube, at a rear end of each of the side frame tubes. The support pads act as a buffer by reducing the impact strength between the chair frame and the bottom tubes during rocking.

Furthermore, each of the connecting pieces is provided with a protective sleeve to be used in contact with the respective U-shaped tube. In the process of unfolding the chair frame, the U-shaped tubes come into contact with the protective sleeves on the surfaces of the connecting pieces to achieve a buffering effect when the connecting pieces are collided, thereby prolonging the service lives of the connecting pieces.

Furthermore, rocking-bar connecting members are disposed on the back of the chair frame at left and right sides, and are rotatably connected to the rocking bars on the same side.

Furthermore, a rear end at the bottom of each of the side frame tubes upwarps, and a front end at the bottom of each of the side frame tubes is fixedly connected to the bottom tube.

With the technical solution according to the present invention, the following advantageous effects are achieved: rocking and folding are enabled by the rocking bar design, and the foldable rocking chair has a small size after being folded and is convenient to store and transport, such that the advantages of light structure, stability, firmness and endurance are achieved; the function of the rocking chair rocking front and back is achieved by virtue of the restoration of the torsional springs, the foldable design provides a small footprint after folding, and the back tubes can be removed before laterally horizontal folding, such that the overall size is small and the rocking chair is more convenient and faster to carry; and compared with the traditional arc-shaped bars that are restricted in a service environment on a horizontal plane, the foldable rocking chair is applicable to uneven ground, guaranteeing the use in a fashion of rocking front and back.

In the figures, reference signs are as follows: 1, seat cushion cloth; 2, side frame tube; 3, protective sleeve; 31, front protective sleeve; 32, rear protective sleeve; 4, rear connecting base; 5, bottom tube; 51, front bottom tube; 52, rear bottom tube; 6, lower rocking bar; 7, torsional spring base; 71, upper torsional-spring protective cover; 72, torsional spring; 73, lower torsional-spring protective cover; 8, upper rocking bar; 9, rocking-bar connecting member; 10, U-shaped tube; 11, bottom-tube connecting member; 111, left connecting section; 112, right connecting section; 113, bearing; 12, support pad; 13, connecting piece; 131, left connecting piece; 132, right connecting piece; 14, adapter; 15, back tube; 16, rear connecting base; 17, protective sleeve; and 18 connecting member.

DETAILED DESCRIPTION OF THE INVENTION

For clearer and more explicit understanding of the technical solutions, the specific embodiments of the specific solutions of the present invention are further set forth in combination with the accompanying drawings.

Figure 1:
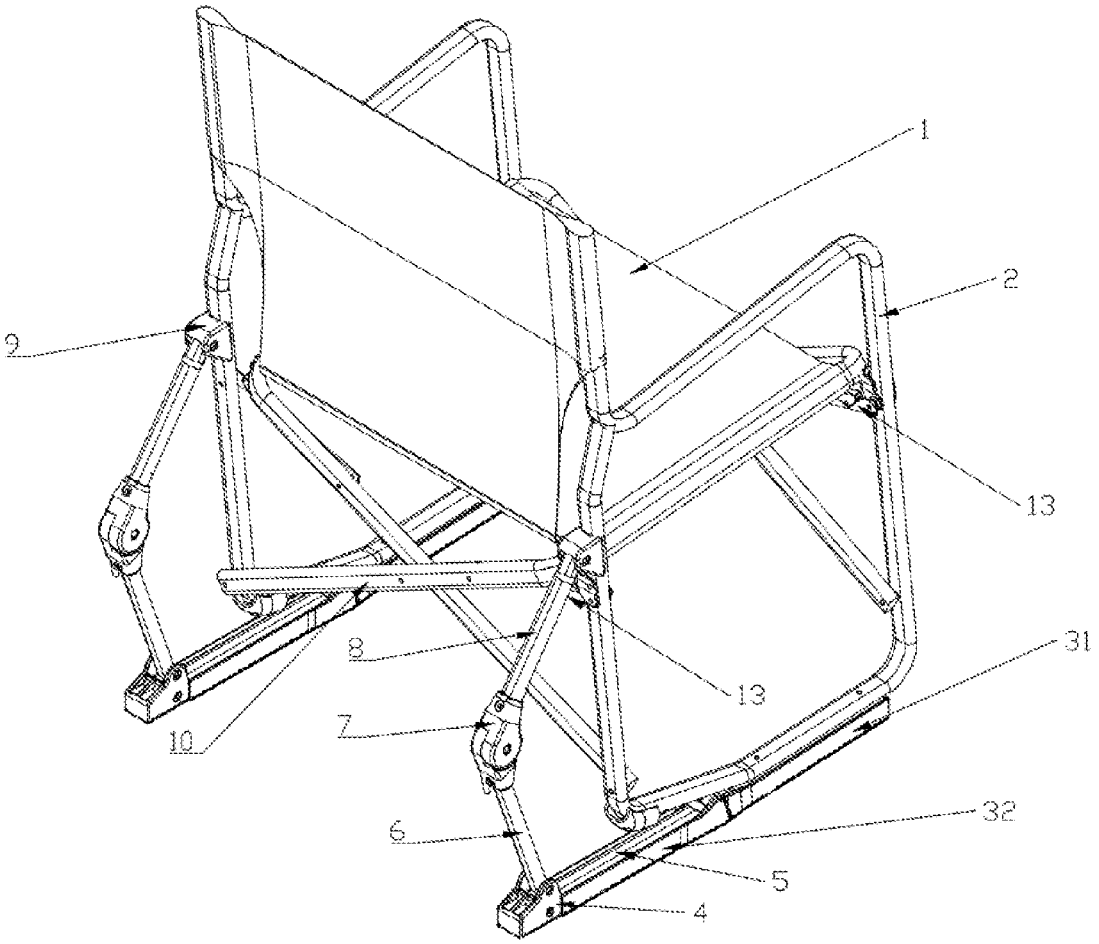
FIG. 1 is a stereogram of a foldable rocking chair.
Figure 2:
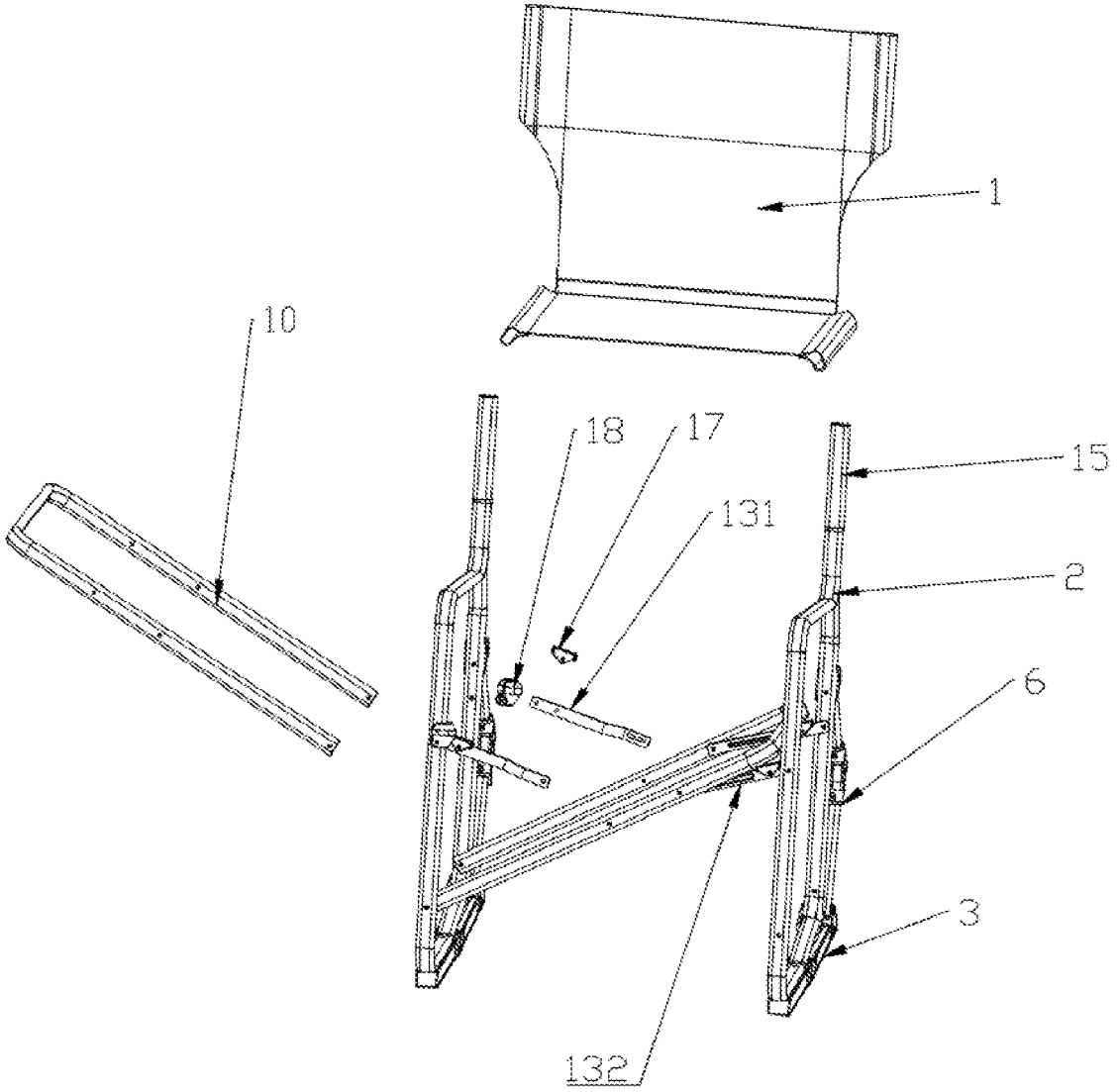
FIG. 2 is a diagram showing a foldable rocking chair in a split state.
Figure 3:
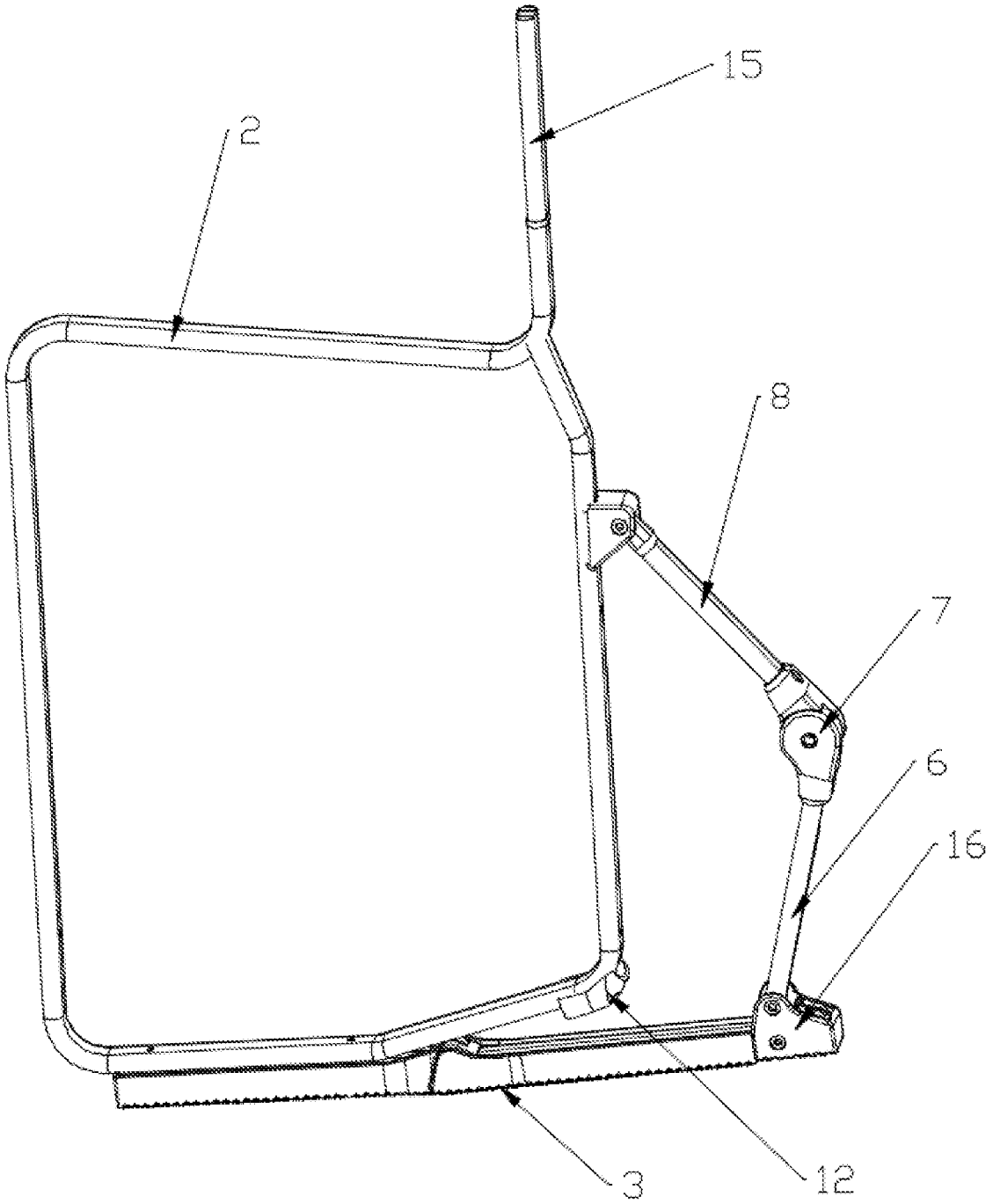
FIG. 3 is a diagram showing side frame tubes and rocking bars in a natural resting state.
Figure 4:
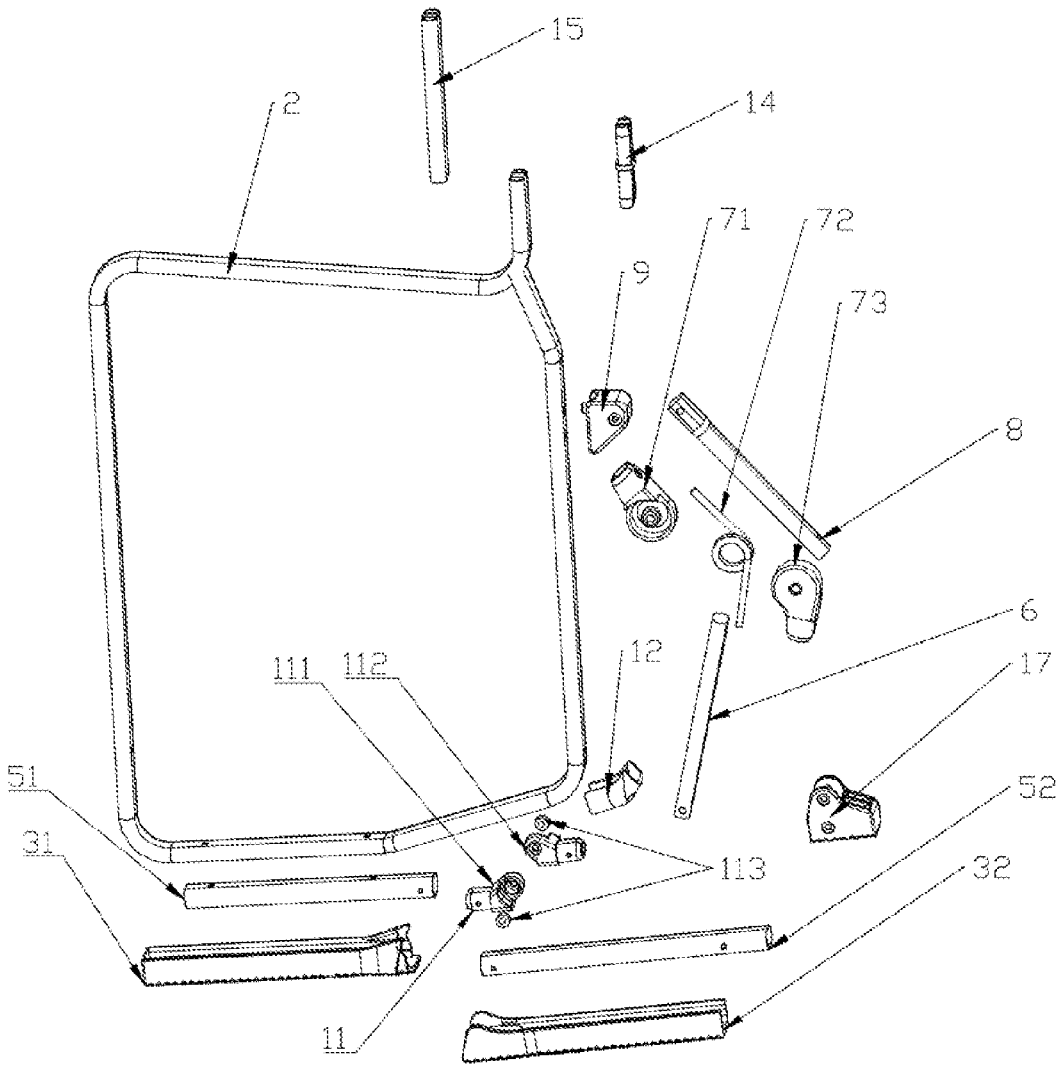
FIG. 4 is a diagram showing side frame tubes and rocking bars in a split state.

As shown in FIGS. 1 to 4, a foldable rocking chair includes a chair frame, a seat cushion cloth 1 and two rocking bars. The chair frame has a foldable design. The seat cushion cloth 1 is detachably installed on the chair frame; left and right sides of a backrest section of the seat cushion cloth 1 are sleeved on tops at two sides of the back of the chair frame; and two side surfaces at left and right sides of a seat cushion section of the seat cushion cloth 1 are installed on left and right sides of the chair frame. The two rocking bars are installed on the left and right sides of the chair frame, respectively.

Each of the rocking bars includes an upper rocking bar 8, a torsional spring base 7, a lower rocking bar 6 and a bottom tube 5. The upper rocking bar 8 and the lower rocking bar 6 are assembled on upper and lower ends of the torsional spring base 7, respectively, and are rotatable via the torsional spring base. Each of the bottom tubes 5 includes a front bottom tube 51 and a rear bottom tube 52; a rear end of the front bottom tube 51 is rotatably connected to the rear bottom tube 52; a lower end of the lower rocking bar 6 is rotatably connected to a rear end of the rear bottom tube 52; and the front bottom tube 52 is fixedly connected to a bottom surface on the left or right side of the chair frame.

In a preferred embodiment, protective sleeves 3 are disposed below both the front bottom tubes 51 and the rear bottom tubes 52, which avoids the direct contact between the bottom tubes 5 and the ground and increases the contact area between the chair and the ground, such that the rocking chair can be laid more stably. The protective sleeves 3 include front protective sleeves 31 and rear protective sleeves 32. The front protective sleeves 31 are installed below the front bottom tubes 51; the rear protective sleeves 32 are installed below the rear bottom tubes 52; the rear sections of the front protective sleeves 31 are rotatably connected to the front sections of the rear protective sleeves 32; and the front protective sleeves 31 rotate along with the rotation of the front bottom tubes 51 relative to the rear bottom tubes 52. The front protective sleeves 31 and the rear protective sleeves 32 are made of soft materials such as plastic or rubber.

In a preferred embodiment, skidproof stripes are disposed on the bottom surfaces of the protective sleeves 3. The skidproof stripes may increase frictions between the chair and the ground, prevent the chair from sliding during usage, and provide convenience for placing the chair on the uneven ground.

In a preferred embodiment, the bottom tubes 5 further include bottom-tube connecting members 11 and rear connecting bases 4. The front bottom tubes 51 are rotatably connected to the rear bottom tubes 52 via the bottom-tube connecting members 11. Each of the bottom-tube connecting members 11 is formed by articulating two components. Both ends of the bottom-tube connecting members 11 are fixed to the front bottom tubes 51 and the rear bottom tubes 52, respectively. When in use, the front bottom tubes 51 and the rear bottom tubes 52 rotate up and down by taking the bottom-tube connecting members 11 as axes. The rear connecting bases 4 are sleeved on rear ends of the rear bottom tubes 52; and upper ends of the rear connecting bases 4 are rotatably connected to the lower rocking bars 6.

In this embodiment, specifically, each of the bottom-tube connecting members 11 includes a left connecting section 111, a right connecting section 112 and two bearings 113; one end of the left connecting section 111 and one end of the right connecting section 112 are each provided with a groove, in which one bearing 113 is installed; and the left connecting section 111, the two bearings 113, and the right connecting section 112 are connected in sequence via a pin shaft to allow the left connecting section 111 and the right connecting section 112 to rotate. Since the other end of the left connecting section 111 and the other end of the right connecting section 112 are fixed to the respective front bottom tube 51 and the respective rear bottom tube 52, respectively, the left connecting section 111 and the right connecting section 112 rotate to drive the respective front bottom tube 51 and the respective rear bottom tube 52 to rotate with respect to each other.

In a preferred embodiment, assembling holes for connecting the rear bottom tubes 52 are disposed in front of the rear connecting bases 4; assembling sections are disposed above the rear connecting bases 4; the lower rocking bars 6 are embedded in and rotatably connected to the assembling sections; and antiskid stripes are disposed on the bottoms of the rear connecting bases 4.

This embodiment provides a specific structure for the torsional spring bases 7. Each of the torsional spring bases 7 includes a torsional spring 72, as well as an upper torsional-spring protective cover 71 and a lower torsional-spring protection cover 73 which are installed on upper and lower ends of the torsional spring respectively; the upper torsional-spring protective cover 71 and the lower torsional-spring protective cover 73 are rotatably connected by taking the torsional spring 72 as a center; and the upper torsional-spring protective cover 71 and the lower torsional-spring protective cover 73 are sleeved on the lower end of the respective upper rocking bar and the upper end of the respective lower rocking bar, respectively.

In a preferred embodiment, the chair frame includes two side frame tubes 2, two back tubes 15, and two U-shaped tubes 10 that are crossed and riveted with openings facing downwards. The side frame tubes are closed rings formed from bent tubes, and the back tubes 15 are pluggably installed on the openings on upper backs of the side frame tubes 2. The upper front and the upper back of each of the side frame tubes 2 are provided with a connecting piece 13, respectively; two bent ends, i.e., upper sides of two upright tubes, of each of the U-shaped tubes 10 are riveted with one of the connecting pieces 13; and two bottoms of each of the U-shaped tubes 10 are rotatably connected to a lower front and a lower back of the opposing side frame tube 2. Two sides of an upper section of the seat cushion cloth 1 are fixed to the back tubes 15, and two sides of a lower section of the seat cushion cloth 1 are fixed on cross tubes of the two U-shaped tubes 10, respectively. Each of the connecting pieces 13 is sleeved with a protective sleeve 17, made of a soft material such as plastic or rubber, for use in contact with the respective U-shaped tube to achieve a buffering effect when the connecting pieces 13 are collided during the folding or unfolding of the U-shaped tubes, such that abrasions caused by the contact between the metallic U-shaped tubes and the metallic connecting pieces.

In an embodiment, a rear end at the bottom of each of the side frame tubes 2 upwarps; and a front end at the bottom of each of the side frame tubes 2 is fixedly connected to the respective front bottom tube 51 by screws and other means. The side frame tubes 2 may be bent into rings having a quadrilateral or pentagonal structure, and the rear end of the bottom tube at the bottom of each of the side frame tubes 2 is bent upwards.

In the chair frame, the two U-shaped tubes are rotatable with respect to each other. With the connection via the connecting pieces 13, the upper ends of the U-shaped tubes 10 and the side frame tubes 2 are also rotatable with respect to each other, and the lower ends of the U-shaped tubes 10 and the opposing side frame tubes 2 are likewise rotatable with respect to each other. Therefore, the whole chair frame is foldable towards the middle.

In a preferred embodiment, each of the connecting pieces includes a left connecting piece 131 and a right connecting piece 132, which are correspondingly installed on the side frame tubes on the left and right sides. The right connecting pieces 131 are straight connecting piece, and the left connecting pieces 132 are bent in multiple segments, for example, Z-shaped connecting pieces, such that fixation is realized while the left U-shaped tube 10 is not blocked during folding. Each of the left connecting pieces 131 is rotatably connected by one connecting member 18, which is sleeved on the respective side frame tube 2 and fixed by a rivet and other means.

In a preferred embodiment, a support pad 12 is disposed on the bottommost of the rear section of any of the side frame tubes 2. The support pad may be made of a soft material such as rubber, sponge and plastic. Since the chair frame is mainly made of metallic tubes, the soft material acts as a buffer to reduce the impact strength between the chair frame and the bottom tubes 5 during rocking.

In a preferred embodiment, a rocking-bar connecting member 9 is disposed behind each of the two side frame tubes 2, and is rotatably connected to the rocking bar on the same side. The rear end of the chair frame is supported by the upper and lower rocking bars, and thus may swing front and back when rocking backwards.

A rocking process of the foldable rocking chair is as follows:

(1) In a normal state, the foldable rocking chair is placed on the ground, wherein the front bottom tubes 51 and the front protective sleeves 31 as well as the rear bottom tubes 52 and the rear protective sleeves 32 are located on the same axis, and the front protective sleeves 31 and the rear protective sleeves 32 both come into contact with the ground;

(2) When a user sits on the seat cushion cloth 1 of the rocking chair to rock backwards, the side frame tubes 2 drive the front bottom tubes 51 and the front protective sleeves 31 to rotate upwards relative to the rear bottom tubes 52; the front bottom tubes 51 and the front protective sleeves 31 get off the ground; and the upper rocking bards 8 rotate and close up towards the direction of the lower rocking bars 6, until the support pads 12 at the rear ends of the bottom surfaces of the side frame tubes 2 are supported against the rear bottom tubes 52; and (3) When rocking forwards, the front bottom tubes 51 and the front protective sleeves 31 return to the ground; and the upper rocking bars 8 rotate relative to the lower rocking bars 6 to stretch and spread upwards, thereby realizing the rocking chair rocking front and back finally.

It should be noted that the above description only provides the preferred embodiments of the present invention as well as the technical principle used therein. It is understandable by those skilled in the art that the present invention is not limited to the specific embodiments described herein. Those skilled in the art can make various obvious variations, readjustments and substitutions without departing from the protection scope of the present invention. Therefore, although the present invention is illustrated in detail by the above embodiments, the present invention is not only limited to the above embodiments, and many other equivalent embodiments may be further included without departing from the conception of the present invention. The scope of the present invention is subject to the scope defined by the appended Claims.

What is claimed is:

1. A foldable rocking chair, comprising a foldable chair frame, a seat cushion cloth and two rocking bars, wherein the seat cushion cloth is detachably installed on the chair frame, and the two rocking bars are installed on left and right sides of the chair frame, respectively;

each of the rocking bars comprises an upper rocking bar, a torsional spring base, a lower rocking bar and a bottom tube, the upper rocking bar and the lower rocking bar are rotatably connected to both ends of the torsional spring base, and an upper end of the upper rocking bar is rotatably connected to a rear end on the left or right side of the chair frame; and each of the bottom tubes is placed on the ground and comprises a front bottom tube and a rear bottom tube, a rear end of the front bottom tube is rotatably connected to a front end of the rear bottom tube, a lower end of the lower rocking bar is rotatably connected to a rear end of the rear bottom tube, and the front bottom tube is fixedly connected to a bottom surface on the left or right side of the chair frame.

2. The foldable rocking chair according to claim 1, wherein each of the rocking bars further comprises protective sleeves, which are sleeved on bottom surfaces of the front and rear bottom tubes.

3. The foldable rocking chair according to claim 2, wherein the protective sleeves comprise front protective sleeves and rear protective sleeves, which are sleeved on the bottom surfaces of the front and rear bottom tubes, respectively.

4. The foldable rocking chair according to claim 1, wherein the bottom tubes further comprise bottom-tube connecting members and rear connecting bases; the front bottom tubes are rotatably connected to the rear bottom tubes via the bottom-tube connecting members; and the rear connecting bases are fixedly connected to the backs of the rear bottom tubes and are simultaneously rotatably connected to the lower ends of the lower rocking bars.

5. The foldable rocking chair according to claim 4, wherein each of the bottom-tube connecting members comprises a left connecting section, a right connecting section and two bearings; one end of the left connecting section and one end of the right connecting section are each provided with one of the bearings and are rotatably connected through a pin shaft; and the other end of the left connecting section and the other end of the right connecting section are fixed to the respective front bottom tube and the respective rear bottom tube, respectively.

6. The foldable rocking chair according to claim 1, wherein each of the torsional spring bases comprises a torsional spring, as well as an upper torsional-spring protective cover and a lower torsional-spring protection cover which are installed on upper and lower ends of the torsional spring respectively; the upper torsional-spring protective cover and the lower torsional-spring protective cover are rotatably connected by taking the torsional spring as a center; and the upper torsional-spring protective cover and the lower torsional-spring protective cover are connected to the upper end of the respective upper rocking rods and the lower end of the respective lower rocking bar, respectively.

7. The foldable rocking chair according to claim 1, wherein the chair frame comprises two side frame tubes, two back tubes, and two U-shaped tubes that are crossed and riveted; the side frame tubes are closed rings formed from bent tubes, and the back tubes are pluggably installed on openings on upper backs of the side frame tubes; the upper front and the upper back of each of the side frame tubes are each provided with a connecting piece, respectively, two bent ends of each of the U-shaped tubes are riveted with one of the connecting pieces, and two bottoms of each of the U-shaped tubes are rotatably connected to a lower front and a lower back of the opposing side frame tube; and two sides of an upper section of the seat cushion cloth are fixed to the back tubes, and two sides of a lower section of the seat cushion cloth are fixed on cross tubes of the U-shaped tubes, respectively.

8. The foldable rocking chair according to claim 7, wherein the connecting pieces comprise a left connecting piece and a right connecting piece, the left connecting piece is a Z-shaped connecting piece, and the right connecting piece is a straight connecting piece;

wherein a support pad is disposed on a lower section, which is in contact with the respective bottom tube, at a rear end of each of the side frame tubes;

wherein each of the connecting pieces is provided with a protective sleeve to be used in contact with the respective U-shaped tube.

9. The foldable rocking chair according to claim 6, wherein a plurality of rocking-bar connecting members are disposed on the back of the chair frame at left and right sides, and are rotatably connected to the rocking bars on the same side;

wherein a rear end at the bottom of each of the side frame tubes upwarps, and a front end at the bottom of each of the side frame tubes is fixedly connected to the bottom tube.

* * * * *